United States Patent [19]

DiBlasio

[11] 4,420,013

[45] Dec. 13, 1983

[54] REGULATOR GUARD

[75] Inventor: Alfonzo W. DiBlasio, Schenectady, N.Y.

[73] Assignee: Cedious, Incorporated, Schenectady, N.Y.

[21] Appl. No.: 320,663

[22] Filed: Nov. 12, 1981

[51] Int. Cl.[3] ..... B65D 25/00

[52] U.S. Cl. ..... 137/382; 220/85 P

[58] Field of Search ..... 137/377, 382, 382.5; 220/85 P

[56] References Cited

U.S. PATENT DOCUMENTS

| | | | |
|---|---|---|---|
| 2,206,707 | 7/1940 | Shaw | 137/382 |
| 2,828,885 | 4/1958 | Lupfer | 220/85 P |
| 2,945,294 | 7/1960 | Courtot et al. | 137/382 |
| 3,958,716 | 5/1976 | Korte | 137/382 |
| 3,964,508 | 6/1976 | Miller | 220/85 P |
| 4,215,581 | 8/1980 | Bolick et al. | 137/382 |

*Primary Examiner*—A. Michael Chambers

*Attorney, Agent, or Firm*—Steven J. Hultquist

[57] ABSTRACT

Due to the inherent design characteristics of a portable gas cylinder, such as narrow base and high center of gravity, complicated by the environment in which they are most commonly found makes them particularly susceptible to being knocked over or dropped. This occurrence usually precludes regulator and gauge damage, resulting in time consuming and costly repairs. The present invention provides a novel means of providing protection to a regulator and its gauges in a manner that is not time consuming to attach, cumbersome to handle, nor obstructs or restricts the operation of the regulator and its gauges.

As an added benefit, the regulator guard provides by virtue of its design a convenient and safe handle by which to carry the cylinder.

4 Claims, 3 Drawing Figures

FIG_1_
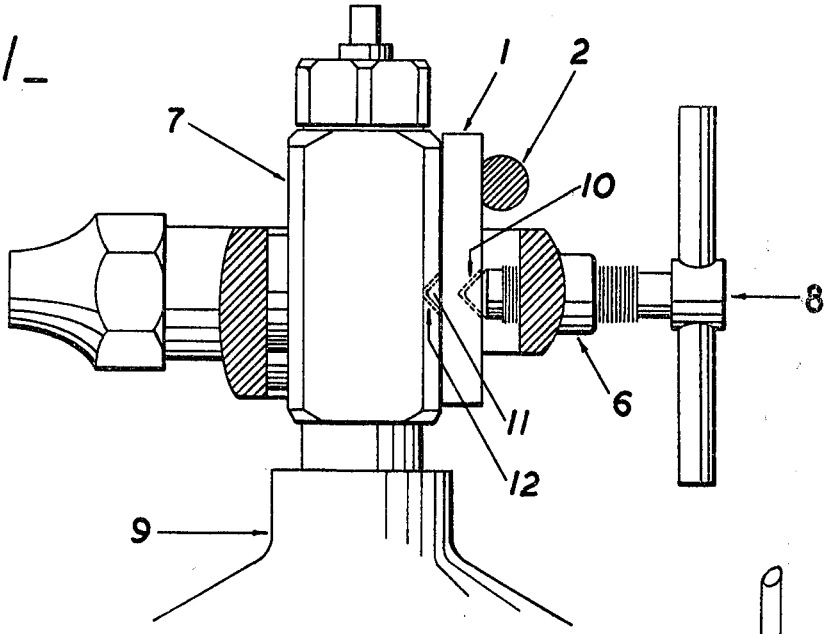
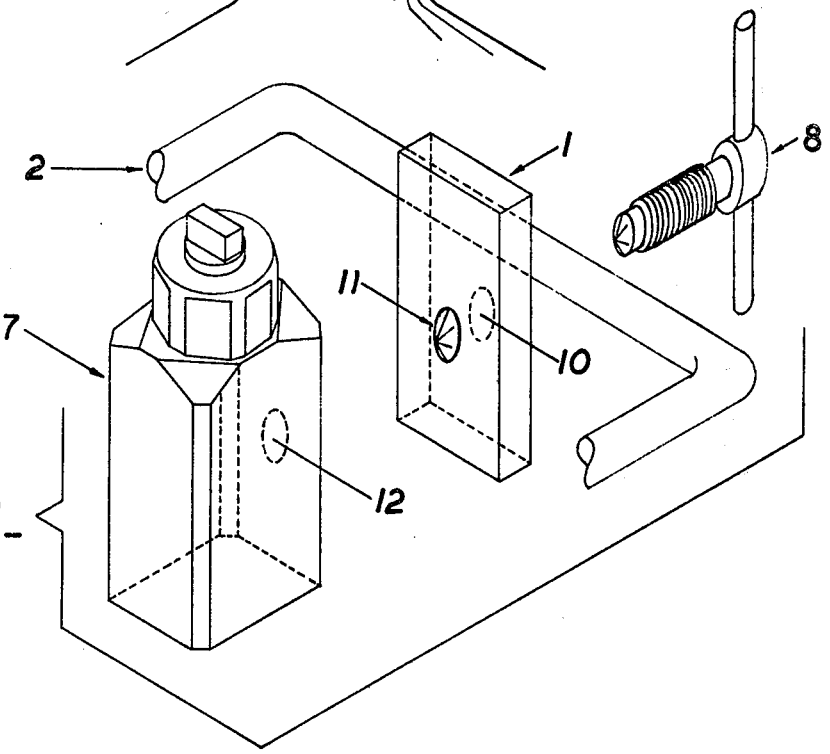
FIG_2_

REGULATOR GUARD

This invention generally relates to gas cylinder attachments and has for its primary objective to provide novel means for protecting the gas regulator and its gauges which attach to the valve head of cylinder sizes "E" and smaller having the Pin Index Safety System valve head.

Another important object of the invention is to provide in a manner as hereinafter set forth a suitable guard of the character described which is adapted to be readily slipped on a conventional valve head and removed therefrom when desired without restricting the use of the gas cylinder, regulator, and its gauges.

Other objectives of the invention are to provide a suitable guard which will be comparatively simple in construction, strong, durable, compact, light of weight, and which may be manufactured at low cost.

These together with other objects and advantages which will become subsequently apparent reside in the details of construction and operation as more fully hereinafter described and claimed, reference being had to the accompanying drawings forming the parts hereof, wherein like numerals refer to like parts throughout, and in which:

GENERAL DESCRIPTION

FIG. 1 is a partially sectioned side view of the regulator yoke and gas cylinder valve head assembly embodying the present invention.

FIG. 2 is an exploded perspective view of the valve head with the mounting block of the present invention and yoke screw separated to show the details of their relationship.

DETAILED DESCRIPTION OF DRAWINGS

Figure 3:
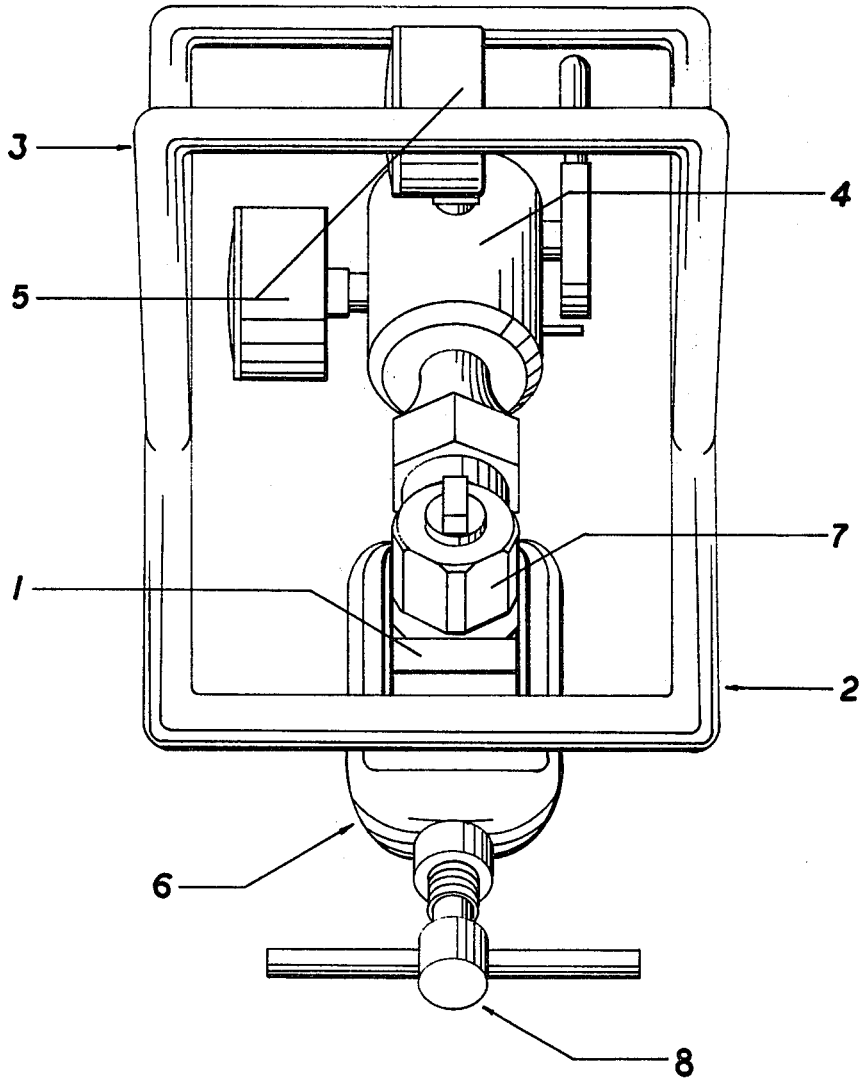
FIG. 3 is a perspective overhead view, showing a regulator quard constructed in accordance with the specifications of the present invention in position with the valve head, and the regulator gauge yoke assembly.

Referring now to the drawings in detail it will be seen that the embodiment of the invention which has been illustrated is comprised of a generally rectangular shaped mounting block of a suitable metal or other material which is designated by reference numeral 1. Affixed to the mounting block 1 is the horizontal guard member 2. Appropriately, vertical guard member 3 is attached to horizontal guard member 2. Both the horizontal guard member 2 and the vertical guard member 3 are constructed of metal or other suitable material as is required to provide protection to the regulator body 4 and gauges 5 on both a horizontal and vertical plane.

The mounting block 1 is of an appropriate design and dimension so as to accommodate its insertion into the regulator yoke 6 between valve head 7 and yoke screw 8. Tightening yoke screw 8, securely fastens the mounting block 1 to the valve head 7.

Gas cylinder 9 is indicated merely to show the orientation of the invention and its embodiment.

Referring now to FIG. 2 in detail. The means for providing proper alignment of the yoke screw 8, mounting block 1, and valve head 7 is accomplished by the collective utilization of mounting block yoke screw seat 10, mounting block seat pin 11, and valve head seat 12.

The foregoing is considered as illustrative only of the principles of the invention. Insomuch as regulators and gauges vary in dimension and style, changes will readily occur to those skilled in the art. It is not desired to limit the invention to the exact construction and operation shown and described, and accordingly all suitable modifications and equivalents may be resorted to falling within the scope of the invention as claimed.

What is claimed as new is as follows:

1. A regulator guard for protecting a regulator and gauge assembly joined to a valve head of a gas cylinder, comprising:

a mounting block member with front and rear surfaces having a conical protrusion on said front surface and a corresponding conical depression on said rear surface;

said valve head having a surface with a conical depression therein abuttingly mating with said front surface of said mounting block member such that said conical depression on the valve head mating surface engages said conical protrusion on the mounting block member front surface;

means joined to said mounting block member forming a protective structure for said regulator and gauge assembly;

a yoke securing said regulator and gauge assembly to said valve head, said yoke horizontally circumscribing said valve head and mounting block member abuttingly mated therewith and tightenable thereagainst by an adjustable screw having a conical front end engaging said conical depression on said rear surface of said mounting block member, whereby said protective structure-forming means are securedly positioned to protect said regulator and gauge assembly from impact damage.

2. A regulator guard according to claim 1 wherein said means forming a protective structure for said regulator and gauge assembly comprise an array of interconnected discrete structural members horizontally and vertically circumscribing said regulator and gauge assembly.

3. A regulator guard according to claim 2 wherein said interconnected discrete structural members of said array are of rod-like form whereby said array provides an enclosing cage structure for protecting said regulator and gauge assembly.

4. A regulator guard according to claim 1 which is positioned and adapted to function as a handle carrying means for manual transport of said gas cylinder.

* * * * *